US005917413A

United States Patent [19]

Malin

[11] Patent Number: 5,917,413

[45] Date of Patent: Jun. 29, 1999

[54] WATER ENTRY ALARM SYSTEM WHICH PROTECTS AGAINST FALSE TRIGGERING AND METHOD THEREFOR

[75] Inventor: Roger D. Malin, Glendale, Ariz.

[73] Assignee: William F. Hogg

[ * ] Notice: This patent issued on a continued prosecution application filed under 37 CFR 1.53(d), and is subject to the twenty year patent term provisions of 35 U.S.C. 154(a)(2).

[21] Appl. No.: 08/720,080

[22] Filed: Sep. 27, 1996

[51] Int. Cl.[6] ..... G08B 21/00

[52] U.S. Cl. ..... 340/573.1; 340/539; 340/540; 340/552; 340/566; 340/604; 367/131

[58] Field of Search ..... 340/573, 539, 340/540, 529, 566, 825.58, 604, 552; 367/48, 131

[56] References Cited

U.S. PATENT DOCUMENTS

| | | | |
|---|---|---|---|
| 3,701,103 | 10/1972 | Padgett et al. | 340/825.58 |
| 3,810,146 | 5/1974 | Lieb | 340/541 |
| 4,305,143 | 12/1981 | Simms et al. | 367/134 |
| 4,500,976 | 2/1985 | DuBroff | 367/48 |
| 4,932,009 | 6/1990 | Lynch | 340/566 |
| 5,049,859 | 9/1991 | Arnell | 340/573 |
| 5,091,714 | 2/1992 | De Solminihac | 340/573 |
| 5,097,254 | 3/1992 | Merrithew | 340/529 |
| 5,144,285 | 9/1992 | Gore | 340/573 |
| 5,195,060 | 3/1993 | Roll | 340/566 |
| 5,268,673 | 12/1993 | Nelson et al. | 340/566 |
| 5,369,623 | 11/1994 | Zerangue | 340/568 |
| 5,408,222 | 4/1995 | Yaffe et al. | 340/539 |
| 5,638,048 | 6/1997 | Curry | 340/552 |

*Primary Examiner*—Jeffrey A. Hofsass
*Assistant Examiner*—Davetta Woods
*Attorney, Agent, or Firm*—Harry M. Weiss; Jeffrey D. Moy; Harry M. Weiss & Associates, P.C.

[57] ABSTRACT

A high sensitive water entry alarm system which prevents outside noise from falsely triggering the alarm system. A transmitter generates ultrasonic timed acoustic bursts at a fixed frequency when it is submerged in water. A receiver located in the body of water senses for acoustic signals similar in characteristic to the transmitter signal. A comparing circuit coupled to the receiver compares the acoustic signals received by the receiver to a reference signal having the same fixed frequency as the transmitter signal. The comparing circuit also measures the duration of the acoustic signals received by the receiver. The comparing circuit will generate a alarm signal which will sound off an audible alarm only when the acoustic signal received by the receiver has the same fixed frequency and is transmitted in controlled burst at the same timed intervals as the transmitter signal.

29 Claims, 2 Drawing Sheets

WATER ENTRY ALARM SYSTEM WHICH PROTECTS AGAINST FALSE TRIGGERING AND METHOD THEREFOR

BACKGROUND OF THE INVENTION

1. Field of the Invention:

This invention relates to alarm systems and, more specifically, to a water entry alarm system which will generate an audible alarm signal when a protected non-swimmer has entered a body of water and which prevents noise around the body of water from falsely triggering the audible alarm.

2. Description of the Prior Art:

Throughout the world, specifically in the United States, numerous deaths occur due to small children, or other non-swimmers, accidentally falling into swimming pools. The problem has become so severe in certain areas of the United States that local ordinances require that protective fencing be placed around all newly built swimming pools. Even with protective fencing, accidental drownings of small children still occur due to holes in the fencing or, more commonly, unlocked fencing gates.

Numerous devices have been designed and built which will generate an audible alarm signal when a person has accidentally fallen into a swimming pool. U.S. Pat. No. 3,810,146, issued to Lieb, discloses an alarm system for warning people when a non-swimmer has fallen into a swimming pool. The alarm system uses a receiver which senses signals generated by a transmitter which is worn by the non-swimmer. When the receiver senses the signal, it will sound the audible alarm. While the alarm system does work, it is susceptible to signals which may falsely sound the alarm system. The receiver has no way to distinguish if the signal received was generated by the transmitter, or if the signal was generated by outside noise around the swimming pool. Furthermore, the sensing device requires a 110 VAC power source which raises the possibility of electrical shock in and around the swimming pool.

U.S. Pat. No. 5,049,859, issued to Arnell, discloses another water entry alarm system. The alarm system of Arnell is similar in design to Lieb. The alarm system uses a receiver which senses signals generated by a transmitter which is worn by the non-swimmer. When the receiver senses the signal, it will sound an audible alarm. The Arnell transmitter generates a low frequency signal generally in the range of 1 kHz to 10 kHz. The problem with this is that low frequency signals in the 1 kHz to 10 kHz range are present in large quantities in the pool environment (i.e., pool cleaning equipment, pool pumps, external noise, etc). These conditions make it extremely difficult to reliably detect alarm conditions. Thus, like Lieb, the Arnell system is susceptible to signals which may falsely sound the alarm system. The Arnell receiver has no way to distinguish if the signal received was generated by the transmitter or if the signal was generated by outside noise around the swimming pool. Another problem with the Arnell receiver is that it uses a hydrophone. Hydrophones are extremely expensive underwater receivers which makes the system cost prohibitive to the average consumer. Furthermore, like the Lieb system, the Arnell receiver requires a 110 VAC power source which raises the possibility of electrical shock in and around the swimming pool.

Another pool alarm system is disclosed in U.S. Pat. No. 5,144,285, issued to Gore. The Gore system is similar to the two previous alarm systems in that it uses a transmitter-receiver to generate an audible alarm. The transmitter in Gore generates a swept frequency signal. If the receiver senses a signal in the swept frequency range, an audible alarm will sound. Like the two previous systems, the Gore system is susceptible to false alarms. The larger the swept frequency range that the receiver will sense for, the greater the possibility of outside noise falsely generating the audible alarm. Furthermore, like the Arnell system, the Gore system has two other problems. First, the receiver in Gore uses a hydrophone. As stated above, hydrophones are expensive underwater receivers which makes the alarm system cost prohibitive. Furthermore, the Gore receiver requires a 110 VAC power supply. As stated above, the use of an AC power source increases the possibility of electrical shock in and around the swimming pool.

Therefore, a need existed to provide an improved water entry alarm system. The improved water entry alarm system must not be susceptible to outside noise which may falsely trigger the alarm system. The improved alarm system must have a receiver which is able to distinguish whether the signal received was that of the transmitter or if the signal was generated by outside noise around the body of water. The improved water entry alarm system must also be inexpensive to build and maintain thus making the alarm system economically viable to the average consumer.

SUMMARY OF THE INVENTION

In accordance with one embodiment of the present invention, it is an object of the present invention to provide an improved water entry alarm system.

It is another object of the present invention to provide an improved water entry alarm system that is not susceptible to outside noise which may falsely trigger the alarm system.

It is still another object of the present invention to provide an improved water entry alarm system which has a receiver which is able to distinguish whether the signal received was that of the transmitter or if the signal was generated by outside noise around the body of water thereby preventing false triggering of the alarm system.

It is a further object of the present invention to provide an improved water entry alarm system that is inexpensive to build and maintain, thus making the alarm system economically viable to the average consumer.

BRIEF DESCRIPTION OF THE PREFERRED EMBODIMENTS

In accordance with one embodiment of the present invention, an alarm system for providing an audible alarm when a protected non-swimmer has entered a body of water and which prevents outside noise around the body of water from falsely triggering the audible alarm is disclosed. The alarm system comprises a plurality of components one of which is transmitter means for generating a transmitter signal of a fixed frequency and for transmitting controlled bursts of the transmitter signal at timed intervals when the transmitter means is submerged in the body of water. Receiver means are further provided and are located in the body of water. The receiver means are used for sensing acoustic signals similar in characteristic to the transmitter signal. Comparing means are coupled to the receiver means for comparing the acoustic signals received by the receiver means to a reference signal having the same fixed frequency of the transmitter signal and for measuring a duration of the acoustic signals received by the receiver means. The comparing means is also used for generating an alarm signal when the acoustic signal received by the receiver means has the same fixed frequency and is transmitted in controlled bursts at similar timed intervals as the transmitter signal. Alarm means are coupled to the comparing means for generating the audible alarm when the alarm means receives the alarm signal generated by the comparing means.

In accordance with another embodiment of the present invention, a method of providing an alarm system which generates an audible alarm when a protected non-swimmer has entered a body of water and which prevents outside noise around the body of water from falsely triggering the audible alarm is disclosed. The method comprises the steps of: providing transmitter means for generating a transmitter signal of a fixed ultrasonic frequency and for transmitting controlled bursts of the transmitter signal at timed intervals when the transmitter means is submerged in the body of water; providing receiver means located in the body of water for sensing acoustic signals similar in characteristic to the transmitter signal; providing comparing means coupled to the receiver means for comparing the acoustic signals received by the receiver means to a reference signal having the same fixed frequency of the transmitter signal, for measuring a duration of the acoustic signals received by the receiver means, and for generating an alarm signal when the acoustic signal received by the receiver means has the same fixed frequency and is transmitted in controlled bursts at similar timed intervals as the transmitter signal; providing alarm means coupled to the comparing means for generating the audible alarm when the alarm means receives the alarm signal generated by the comparing means; and providing battery means coupled to the receiver means, the comparing means and the alarm means for supplying power to the receiver means, the comparing means and the alarm means.

The foregoing and other objects, features and advantages of the invention will be apparent from the following, more particular, description of the preferred embodiments of the invention, as illustrated in the accompanying drawings.

DETAILED DESCRIPTION OF THE PREFERRED EMBODIMENT

Figure 2:
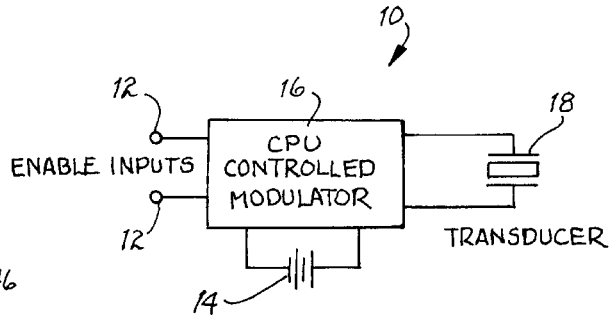
FIG. 2 is a simplified block diagram of the transmitter which forms another portion of the present invention.
Figure 5:
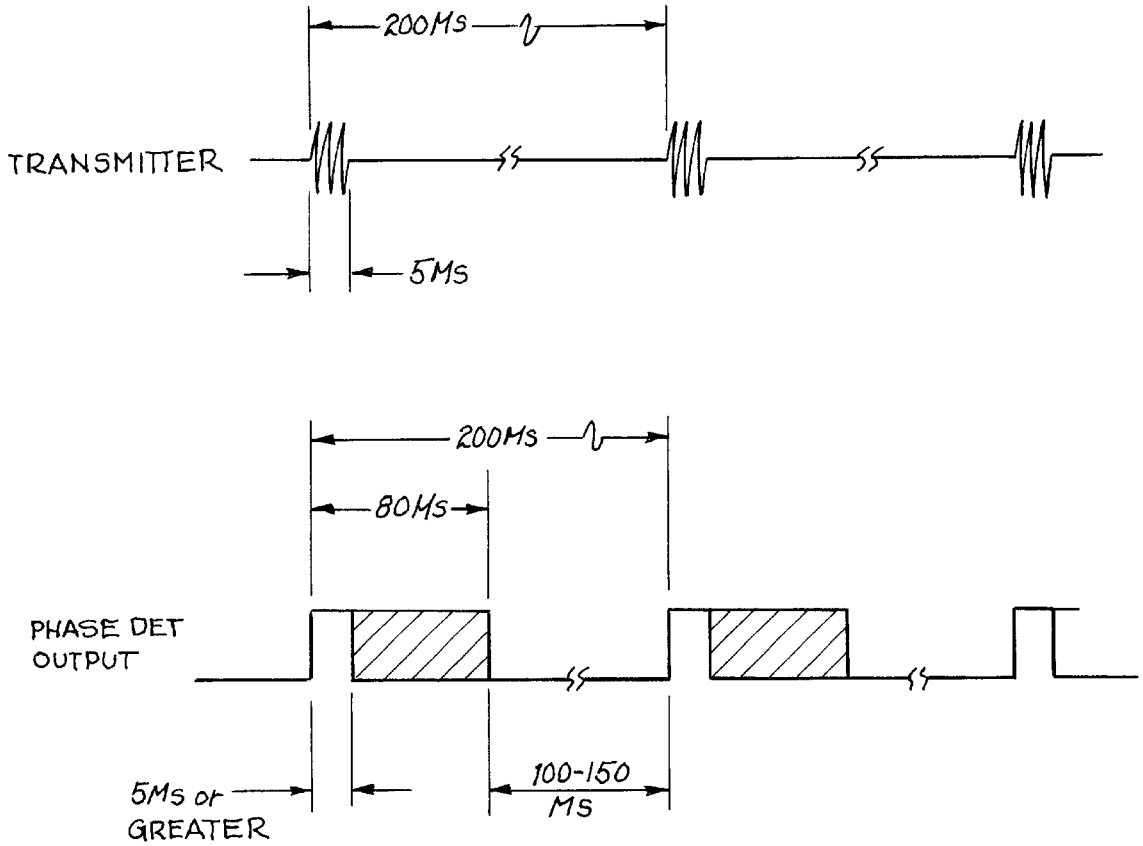
FIG. 5 shows timing diagrams for the transmitter depicted in FIG. 1 and the output from the phase detector depicted in FIG. 4.

Referring to FIG. 2, a simplified electrical block diagram of a transmitter 10 used in the present invention is shown. The transmitter 10 is powered by a battery 14. The transmitter 10 is comprised of a pair of contacts 12. When the transmitter 10 is submerged in water, the conductivity of the water closes the path between the contacts 12. When the path between the contacts 12 is closed, a Central Processing Unit (CPU) controlled modulator 16 generates a signal having a fixed frequency generated in controlled bursts which are sent to the transducer 18. The transducer l8 will vibrate in relation to the controlled bursts generated by the CPU controlled modulator 16. The vibrations will generate acoustic waves which will be transmitted in the water in controlled bursts having a fixed frequency corresponding to the fixed frequency signal generated by the CPU controlled modulator 16. In the preferred embodiment of the present invention, the transmitter 10 generates 131 kHz fixed frequency tone bursts for a period of five (5) milliseconds at a rate of five (5) bursts per second (See FIG. 5) for as long as the transmitter 10 is submerged in the body of water. An ultrasonic acoustic signal is preferred since lower frequency signals may be present in outside noise surrounding the body of water. Furthermore, the use of an ultrasonic acoustic signal is preferred since this will allow the use of a low cost piezo element as a transducer in the receiver 20.

The transmitter 10 would be compact in size and would be housed in a wrist watch like container which would be acceptable for a child to wear on a continuous basis on his/her wrist or ankle. Because of the compact nature of the transmitter 10, the acoustic power output of the transmitter 10 would be limited to a very low 30 mW. The low acoustic power output would allow the battery 14 to have a shelf life of greater than five (5) years and continuous operation in water of over 200 hours (allowing for repeated submersions, typically for test verification).

Figure 3:
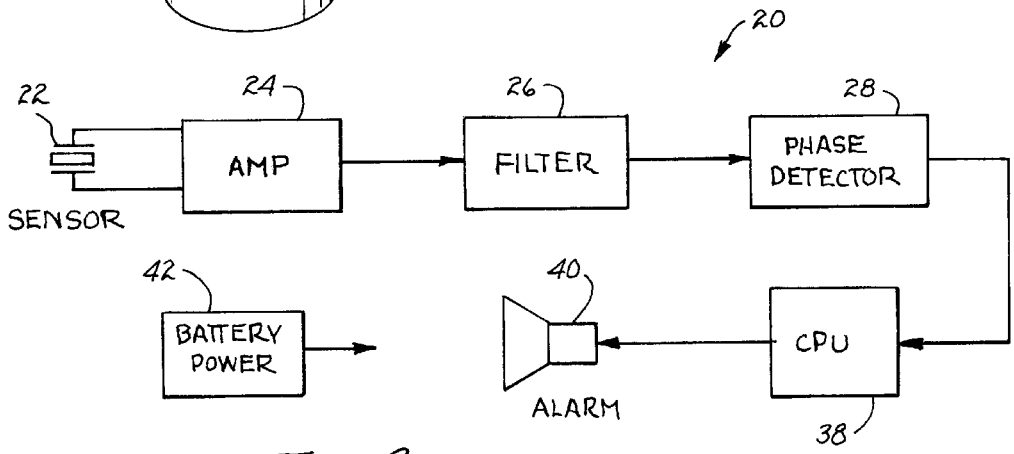
FIG. 3 is a simplified block diagram of the receiver housed in the floatable buoy depicted in FIG. 1.

Referring to FIG. 3, a simplified electrical block diagram of a receiver 20 used in the present invention is shown. The receiver 20 is comprised of a sensor 22. The sensor 22 is placed in the body of water for sensing acoustic signals in and around the body of water. In the preferred embodiment of the present invention, the sensor 22 is a low cost acoustic transducer such as a piezo ceramic transducer. The piezo ceramic transducer is less expensive than a hydrophone typically found in most water entry alarm systems. The piezo ceramic transducer will thereby reduce the cost of the present invention making the present invention economically viable for the average consumer.

An amplifier 24 is coupled to the sensor 22. In the preferred embodiment of the present invention, the amplifier 24 is a high gain, high frequency amplifier. The amplifier 24 is used to boost low level acoustic signals received by the sensor 22.

The amplified signal outputed by the amplifier 24 will then be sent to a filter 26. The filter 26 is used to reject any signals that have a frequency greater than or less than the fixed frequency of the signal generated by the transmitter 10 (FIG. 2). In the preferred embodiment of the present invention, the filter 26 is a bandpass filter that would reject signals having a frequency greater than or less than 131 kHz.

The filtered signal outputed by the filter 26 is then sent to a phase detector 28. The phase detector 28 compares the filtered signal to an internal reference signal that has the same fixed frequency of the signal generated by the transmitter (FIG. 2). If the two signals are nearly in phase (i.e., same frequency +/−2%), the phase detector 28 will translate the amplified signal to a digital level for processing.

Figure 4:
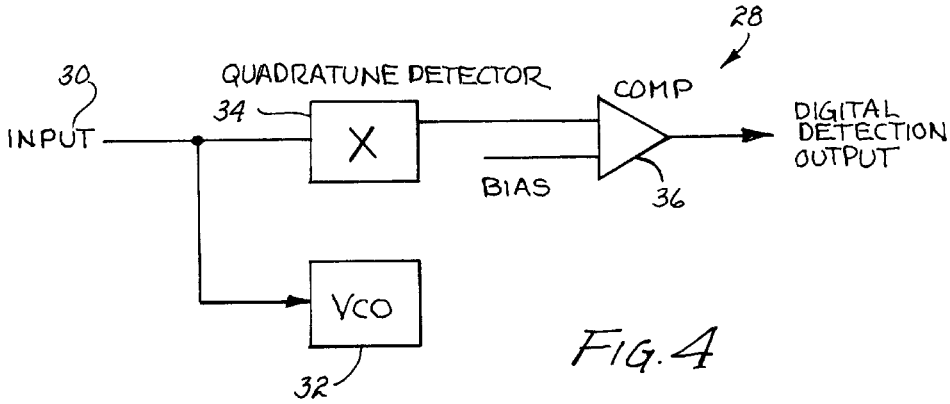
FIG. 4 is a simplified block diagram of the phase detector used in the receiver depicted in FIG. 3.

Referring to FIG. 4, a simplified electrical block diagram of the phase detector 28 is shown. The amplified signal is sent to the input 30 of the phase detector 28. The amplified signal will push a Voltage Controlled Oscillator (VCO) to the incoming frequency of the amplified signal if the amplified signal is very close to the VCO set frequency which is the fixed frequency of the signal generated by the transmitter 10 (FIG. 1) (i.e., 131 kHz in the preferred embodiment of the present invention).

A quadrature detector 34 is driven by both the VCO 32 and to the input 30. The quadrature detector 34 will compare the VCO 32 output frequency with the amplified signal sent through the input 30. When the input signal is in phase with the output signal from the VCO 32, the quadrature detector 34 will produce a DC offset. The DC offset is applied to a comparator 36. When the DC offset exceeds the bias level of the comparator 36, the comparator 36 will produce a digital detection output signal. The digital detection output signal will remain in an active state for as long as the 131 kHz signal is present.

Referring back to FIG. 3, the digital detection output signal from the phase detector 28 is sent to a Central Processing Unit (CPU) 38. The CPU 38 will time the digital detection output signal. If the digital detection output signal meets a specific criteria, a signal will be sent to the alarm circuit 40. The alarm circuit 40 will then sound off an audible alarm. In the preferred embodiment of the present invention, the digital detection output signal must met the specific criteria of three active periods (131 kHz present) greater than five (5) milliseconds but less than 80 milliseconds, followed by an inactive period equal to the period between bursts (i.e., 100–150 milliseconds) (See FIG. 5). Although the transmitter 10 (FIG. 1) generates tone bursts for only five (5) milliseconds, the digital detection output signal may be 5 to 80 milliseconds long as a result of echoes caused by the generated transmitter signal. The echoes from the transmitter signals will not be present for more than 80 milliseconds.

It should be noted that in the preferred embodiment of the present invention, all the components of the receiver 20 are powered by a battery 42. This eliminates the potential of electrical shock which is present in current water entry alarm systems. In general, the receiver should function for over six (6) months on a single set of batteries 42.

Figure 1:
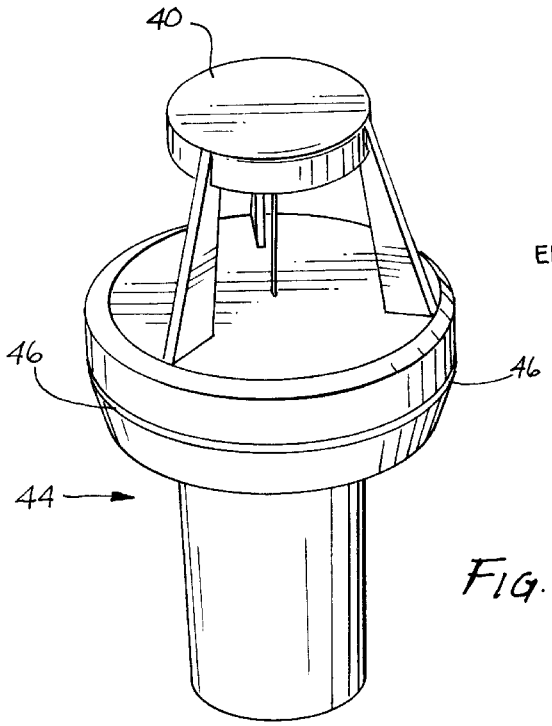
FIG. 1 is an elevated perspective view of a floatable buoy used to house the receiver and the alarm circuit which comprise a portion of the present invention.

Referring now to FIGS. 1 and 3, in the preferred embodiment of the present invention, the receiver 20 is housed in a floatable buoy 44. When the floatable buoy 44 is placed in a body of water, the floatable buoy 44 will be partially submerged up to the water line 46. The floatable buoy 44 is free to float and move anywhere within the body of water. The sensor 22 is placed on the bottom of the floatable buoy 44 and in the body of water to receive acoustic signals in and around the body of water. The alarm circuit 40 is placed on top of the floatable buoy 44 and out of the water so that people will be able to hear the audible alarm when the audible alarm is sounded.

OPERATION

The present invention is a high sensitive water entry alarm system which prevents outside noise from falsely triggering the alarm system. When a transmitter 10 is submerged in a body of water, the transmitter 10 will generate timed ultrasonic acoustic bursts at a fixed frequency. The sensor 22 will listen for any acoustic signals located in and around the body of water. An amplifier 24 will boost the sensed signals and a filter 26 will reject any acoustic signals that have a frequency greater than or less than the fixed frequency of the transmitter signal. A phase detector 28 will then compare the filtered acoustic signal to a reference signal having the same fixed frequency as the transmitter signal. If the two signals are in phase, the phase detector 28 will produce a digital detection output signal. This signal is then sent to a CPU 38 where the digital detection output signal is timed to ensure that it has approximately the same duration as the transmitter signal. If the two signals are approximately the same duration, an audible alarm is sounded. Thus, the present invention will only sound if the acoustic signal received by the sensor 22 is of the same frequency and approximately the same duration as the signal generated by the transmitter 10.

While the invention has been particularly shown and described with reference to a preferred embodiment thereof, it should be understood by those skilled in the art that changes in form and detail may be made therein without departing from the spirit and scope of the invention.

What is claimed is:

1. An alarm system for providing an audible alarm when at least one individual protected by said system has entered a body of water and which prevents ambient noise in or around said body of water from falsely triggering the audible alarm comprising, in combination:

transmitter means worn by at least one individual for generating a signal of fixed frequency and for transmitting controlled bursts of said transmitter signal at timed intervals, which prevents a false triggering of the alarm system, immediately upon submergence of said transmitter means in said body of water;

receiver means located in said body of water and remotely located from said transmitter for directly sensing non-reflected ultrasonic acoustic signals similar in characteristic to said transmitter signal;

comparing means coupled to said receiver means for comparing said acoustic signals received by said receiver means to a reference signal having said fixed frequency of said transmitter signal, for measuring a duration of said acoustic signals received by said receiver means, and for generating an alarm signal when said acoustic signal received by said receiver means has said fixed frequency and is transmitted in controlled bursts at similar timed intervals as said transmitter signal, which prevents a false triggering of the alarm system; and alarm means coupled to said comparing means for generating said audible alarm when said alarm means receives said alarm signal generated by said comparing means.

2. An alarm system in accordance with claim 1 wherein said transmitter signal is an ultrasonic acoustic signal.

3. An alarm system in accordance with claim 2 wherein said transmitter means comprises:

modulator means for generating said ultrasonic acoustic signal in controlled bursts at said timed intervals;

transducer means coupled to said modulator means for transmitting said ultrasonic acoustic signal in controlled bursts at said timed intervals;

transmitter battery means coupled to said modulator means for supplying power to said transducer means and to said modulator means; and contact means coupled to said modulator means for activating said transmitter means to generate and transmit said ultrasonic acoustic signal in controlled bursts at said timed intervals when said transmitter means is submerged in said body of water.

4. An alarm system in accordance with claim 1 further comprising battery means coupled to said receiver means, said comparing means and said alarm means for supplying power to said receiver means, said comparing means and said alarm means.

5. An alarm system in accordance with claim 4 further comprising floatable buoy means for housing said receiver means, said comparing means, said alarm means and said battery means and for allowing said receiver means, said comparing means, said alarm means and said battery means to freely float in said body of water to allow said receiver means to sense said acoustic signals in said body of water.

6. An alarm system in accordance with claim 1 wherein said receiver means is an acoustic transducer.

7. An alarm system in accordance with claim 6 wherein said acoustic transducer is a piezo ceramic transducer.

8. An alarm system in accordance with claim 1 wherein said comparing means comprises:

amplifier means for receiving said acoustic signals sensed by said receiver and for generating boosted acoustic signals;

filter means coupled to said amplifier means for blocking out said boosted acoustic signals that are of a greater frequency than said transmitter signal transmitted at said fixed frequency and for blocking out said boosted acoustic signals that are of a lesser frequency than said transmitter signal transmitted at said fixed frequency;

phase detector means coupled to said filter means for comparing said boosted acoustic signals outputed by said filter means to said reference signal and for generating a digital output signal when said boosted acoustic signals are in phase with said reference signal; and Central Processing Unit (CPU) means coupled to said phase detector means for receiving said digital output signal outputed from said phase detector means and for generating said alarm signal when said digital output signal is being transmitted in bursts at time intervals similar to said timed intervals of said transmitter signal.

9. An alarm system in accordance with claim 8 wherein said amplifier means is a high gain, high frequency amplifier.

10. An alarm system in accordance with claim 8 wherein said phase detector means comprises:

Voltage Controlled Oscillator (VCO) means for generating said reference signal;

quadrature detector means coupled to an output of said VCO means for comparing said reference signal to said boosted acoustic signals outputed by said filter means and for producing a DC offset when said boosted acoustic signals outputed by said filter means are in phase with said reference signal; and comparator means for generating said digital output signal when said DC offset exceeds a bias level.

11. An alarm system for providing an audible alarm when at least one individual protected by said system has entered a body of water and which prevents ambient noise in or around said body of water from falsely triggering the audible alarm comprising, in combination:

transmitter means worn by at least one individual for generating an ultrasonic acoustic signal of fixed frequency and for transmitting controlled bursts of said transmitter signal at timed intervals, which prevents a false triggering of the alarm system, immediately upon submergence of said transmitter means in said body of water, said transmitter means comprising:

modulator means for generating said ultrasonic acoustic signal in controlled bursts at said timed intervals;

transducer means coupled to said modulator means for transmitting said ultrasonic acoustic signal in controlled bursts at said timed intervals;

transmitter battery means coupled to said modulator means for supplying power to said transducer means and to said modulator means; and contact means coupled to said modulator means for activating said transmitter means to generate and transmit said ultrasonic acoustic signal in controlled bursts at said timed intervals when said transmitter means is submerged in said body of water;

receiver means located in said body of water and remotely located from said transmitter for directly sensing non-reflected ultrasonic acoustic signals similar in characteristic to said transmitter signal;

comparing means coupled to said receiver means for comparing said acoustic signals received by said receiver means to a reference signal having said fixed frequency of said transmitter signal, for measuring a duration of said acoustic signals received by said receiver means, and for generating an alarm signal when said acoustic signal received by said receiver means has said fixed frequency and is transmitted in controlled bursts at similar timed intervals as said transmitter signal, which prevents a false triggering of the alarm system, said comparing means comprising:

amplifier means for receiving said acoustic signals sensed by said receiver and for generating boosted acoustic signals;

filter means coupled to said amplifier means for blocking out said boosted acoustic signals that are of a greater frequency than said transmitter signal transmitted at said fixed frequency and for blocking out said boosted acoustic signals that are of a lesser frequency than said transmitter signal transmitted at said fixed frequency;

phase detector means coupled to said filter means for comparing said boosted acoustic signals outputed by said filter means to said reference signal and for generating a digital output signal when said boosted acoustic signals are in phase with said reference signal; and Central Processing Unit (CPU) means coupled to said phase detector means for receiving said digital output signal outputed from said phase detector means and for generating said alarm signal when said digital output signal is being transmitted in bursts at time intervals similar to said timed intervals of said transmitter signal; and alarm means coupled to said comparing means for generating said audible alarm when said alarm means receives said alarm signal generated by said comparing means.

12. An alarm system in accordance with claim 11 further comprising battery means coupled to said receiver means, said comparing means and said alarm means for supplying power to said receiver means, said comparing means and said alarm means.

13. An alarm system in accordance with claim 12 further comprising floatable buoy means for housing said receiver means, said comparing means, said alarm means and said battery means and for allowing said receiver means, said comparing means, said alarm means and said battery means to freely float in said body of water to allow said receiver means to sense said acoustic signals in said body of water.

14. An alarm system in accordance with claim 11 wherein said receiver means is an acoustic piezo ceramic transducer.

15. An alarm system in accordance with claim 11 wherein said phase detector means comprises:

Voltage Controlled Oscillator (VCO) means for generating said reference signal;

quadrature detector means coupled to an output of said VCO means for comparing said reference signal to said boosted acoustic signals outputed by said filter means and for producing a DC offset when said boosted acoustic signals outputed by said filter means are in phase with said reference signal; and comparator means for generating said digital output signal when said DC offset exceeds a bias level.

16. A method of providing an alarm system for providing an audible alarm when at least one individual protected by said system has entered a body of water and which prevents ambient noise in or around said body of water from falsely triggering the audible alarm comprising the steps of:

providing transmitter means worn by at least one individual for generating an ultrasonic acoustic signal of fixed frequency and for transmitting controlled bursts of said transmitter signal at timed intervals, which prevents a false triggering of the alarm system, immediately upon submergence of said transmitter means in said body of water;

providing receiver means located in said body of water and remotely located from said transmitter for directly sensing non-reflected ultrasonic acoustic signals similar in characteristic to said transmitter signal;

providing comparing means coupled to said receiver means for comparing said acoustic signals received by said receiver means to a reference signal having said fixed frequency of said transmitter signal, for measuring a duration of said acoustic signals received by said receiver means, and for generating an alarm signal when said acoustic signal received by said receiver means has said fixed frequency and is transmitted in controlled bursts at similar timed intervals as said transmitter signal, which prevents a false triggering of the alarm system,; and providing alarm means coupled to said comparing means for generating said audible alarm when said alarm means receives said alarm signal generated by said comparing means.

17. The method of claim 16 wherein said step of providing said transmitter means further comprises the steps of:

providing modulator means for generating said ultrasonic acoustic signal in controlled bursts at said timed intervals;

providing transducer means coupled to said modulator means for transmitting said ultrasonic acoustic signal in controlled bursts at said timed intervals;

providing transmitter battery means coupled to said modulator means for supplying power to said transducer means and to said modulator means; and providing contact means coupled to said modulator means for activating said transmitter means to generate and transmit said transmitter signal in controlled bursts at said timed intervals when said transmitter means is submerged in said body of water.

18. The method of claim 16 further comprising the step of providing floatable buoy means for housing said receiver means, said comparing means, said alarm means and said battery means and for allowing said receiver means, said comparing means, said alarm means and said battery means to freely float in said body of water to allow said receiver means to sense said acoustic signals in said body of water.

19. The method of claim 16 wherein said step of providing comparing means further comprises the steps of:

providing amplifier means for receiving said acoustic signals sensed by said receiver and for generating boosted acoustic signals;

providing filter means coupled to said amplifier means for blocking out said boosted acoustic signals that are of a greater frequency than said transmitter signal at said fixed frequency and for blocking out said boosted acoustic signals that are of a lesser frequency than said transmitter signal at said fixed frequency;

providing phase detector means coupled to said filter means for comparing said boosted acoustic signals outputed by said filter means to said reference signal and for generating a digital output signal when said boosted acoustic signals are in phase with said reference signal; and providing CPU means coupled to said phase detector means for receiving said digital output signal outputed from said phase detector means and for generating said alarm signal when said digital output signal is being transmitted in bursts at time intervals similar to said timed intervals of said transmitter signal.

20. The method of claim 19 wherein said step of providing phase detector means further comprises the steps of:

providing VCO means for generating said reference signal;

providing quadrature detector means coupled to an output of said VCO means for comparing said reference signal to said boosted acoustic signals outputed by said filter means and for producing a DC offset when said boosted acoustic signals outputed by said filter means are in phase with said reference signal; and providing comparator means for generating said digital output signal when said DC offset exceeds a bias level.

21. An alarm system in accordance with claim 1 wherein said transmitter means generates 131 kHz fixed frequency tone bursts for as long as said transmitter means is submerged in said body of water.

22. An alarm system in accordance with claim 1 wherein said transmitter means generates said controlled bursts for a period of five milliseconds at a rate of five bursts per second for as long as said transmitter means is submerged in said body of water.

23. An alarm system in accordance with claim 1 wherein the length of time between said controlled bursts must be greater than 80 milliseconds.

24. An alarm system in accordance with claim 11 wherein said transmitter means generates 131 kHz fixed frequency tone bursts for as long as said transmitter means is submerged in said body of water.

25. An alarm system in accordance with claim 11 wherein said transmitter means generates said controlled bursts for a period of five milliseconds at a rate of five bursts per second for as long as said transmitter means is submerged in said body of water.

26. An alarm system in accordance with claim 11 wherein the length of time between said controlled bursts must be greater than 80 milliseconds.

27. An alarm system in accordance with claim 16 wherein said transmitter means generates 131 kHz fixed frequency tone bursts for as long as said transmitter means is submerged in said body of water.

28. An alarm system in accordance with claim 16 wherein said transmitter means generates said controlled bursts for a period of five milliseconds at a rate of five bursts per second for as long as said transmitter means is submerged in said body of water.

29. An alarm system in accordance with claim 16 wherein the length of time between said controlled bursts must be greater than 80 milliseconds.

* * * * *